US007806271B1

(12) United States Patent
Kraska

(10) Patent No.: US 7,806,271 B1
(45) Date of Patent: Oct. 5, 2010

(54) AUDIO CADDY

(76) Inventor: Leona M. Kraska, 815 N. Campbell Rd., Royal Oak, MI (US) 48067

( * ) Notice: Subject to any disclaimer, the term of this patent is extended or adjusted under 35 U.S.C. 154(b) by 0 days.

(21) Appl. No.: 12/257,375

(22) Filed: Oct. 23, 2008

(51) Int. Cl.
*A45C 11/20* (2006.01)

(52) U.S. Cl. ..... 206/542; 206/576; 206/216; 206/541; 220/212.5

(58) Field of Classification Search ..... 206/542, 206/216, 573, 459.1, 576, 579, 541, 223, 206/315.11, 314, 320; 220/212, 212.5, 326, 220/324; 381/334, 87; 455/350, 3.06; 62/457.1, 62/457.7
See application file for complete search history.

(56) References Cited

U.S. PATENT DOCUMENTS

| | | | | | |
|---|---|---|---|---|---|
| 4,279,342 | A | * | 7/1981 | Van Pelt | 206/542 |
| 4,491,239 | A | * | 1/1985 | Chapman | 220/840 |
| 4,571,740 | A | * | 2/1986 | Kirby et al. | 455/344 |
| 4,589,546 | A | * | 5/1986 | Sunderland | 206/315.11 |
| 4,700,395 | A | * | 10/1987 | Long | 381/334 |
| D296,066 | S | * | 6/1988 | Tarozzi et al. | D7/605 |
| 4,817,191 | A | * | 3/1989 | Adams | 455/351 |
| 4,841,661 | A | * | 6/1989 | Moore | 43/54.1 |
| 4,939,912 | A | * | 7/1990 | Leonovich, Jr. | 62/457.1 |
| D321,515 | S | * | 11/1991 | Harris | D14/168 |
| D334,868 | S | * | 4/1993 | Lau Woon | D7/605 |
| 5,235,822 | A | * | 8/1993 | Leonovich, Jr. | 62/457.2 |
| 5,447,041 | A | * | 9/1995 | Piechota | 62/457.7 |
| D364,161 | S | * | 11/1995 | Campbell | D14/168 |
| D365,733 | S | * | 1/1996 | Freedland | D7/710 |
| D375,311 | S | * | 11/1996 | Keseling et al. | D14/168 |
| 5,781,853 | A | * | 7/1998 | Johnson | 455/351 |
| 5,810,168 | A | * | 9/1998 | Eggering | 206/372 |
| 5,979,175 | A | * | 11/1999 | Ellison | 62/457.7 |
| 6,068,118 | A | * | 5/2000 | Calloway | 206/233 |
| D441,738 | S | * | 5/2001 | Schuiling | D14/168 |
| 6,305,185 | B1 | * | 10/2001 | Sloan | 62/457.7 |
| 6,611,657 | B2 | * | 8/2003 | Flannery | 386/125 |
| 6,634,768 | B2 | * | 10/2003 | McKenzie et al. | 362/253 |
| D499,612 | S | * | 12/2004 | Smith, Sr. | D7/605 |
| D514,892 | S | * | 2/2006 | Lee | D7/605 |
| 7,143,601 | B1 | * | 12/2006 | Jimenez | 62/457.7 |
| 7,628,271 | B1 | * | 12/2009 | Marton | 206/320 |
| 2003/0015513 | A1 | * | 1/2003 | Ellis | 219/400 |
| 2003/0139169 | A1 | * | 7/2003 | Arreazola, Jr. | 455/344 |
| 2004/0237574 | A1 | * | 12/2004 | Donald et al. | 62/457.7 |
| 2005/0018392 | A1 | * | 1/2005 | Strohmeier et al. | 361/683 |
| 2005/0236285 | A1 | * | 10/2005 | Ng et al. | 206/308.1 |
| 2006/0178172 | A1 | * | 8/2006 | Yuen | 455/575.1 |
| 2010/0126196 | A1 | * | 5/2010 | McCance | 62/264 |

* cited by examiner

*Primary Examiner*—David T Fidei

(57) ABSTRACT

A container for recreational or food items comprises a housing with a handle and a lid made of durable plastic and a compartment inside the housing. A portable CD player/radio and a battery compartment for rechargeable batteries are built in the housing under the compartment. The face of the CD player/radio with controls, display, and the front of a CD drawer being built onto the bottom of a front face of the housing, an AC adaptor jack and a first speaker for the CD player/radio are built into one side of the housing, a headset jack and a second speaker for the CD player/radio are built into another side of the housing.

6 Claims, 6 Drawing Sheets

AUDIO CADDY

BACKGROUND OF THE INVENTION

The present disclosure relates to a container for transporting recreational or food items, for example a lunchbox, combined with a CD player/radio.

Whereas known in the art are containers for transporting food items such as coolers or lunchboxes, on the one hand, and CD players/radio, on the other hand, a need is made itself felt for an easy-to-use, convenient and portable combination of such a container for recreational needs and a CD player/radio.

BRIEF SUMMARY OF THE DISCLOSURE

This goal is proposed to attain by providing a container comprising a housing with a handle and a lid adapted to swing open to reveal a compartment inside the housing, and a portable CD player/radio built in the housing under the compartment.

The face of the CD player/radio with controls, display, and the front of a CD drawer are proposed to be built onto the bottom of a front face of the housing.

A battery compartment for rechargeable batteries for the CD player/radio is also proposed to be built in the housing under the compartment The housing, handle and lid of the container are made of durable plastic.

An AC adaptor jack and a first speaker for the CD player/radio are proposed to be built into one side of the housing, whereas a headset jack and a second speaker for the CD player/radio are proposed to be built into another side of the housing.

A side button can be provided on the top of the handle to open the lid, or a clasp can be built onto a front side of the housing, whereby the lid can be freed up by undoing the clasp.

The above-identified features are believed to fulfill the need for a convenient, simple, reliable and easy in use caddy.

BRIEF DESCRIPTION OF DRAWINGS

Other objects, features and advantages of the disclosure will become apparent to one skilled in the art by reading the following specification and subjoined claims and by referencing the following drawings, in which:

DETAILED DESCRIPTION OF THE PREFERRED EMBODIMENT

Figure 1:
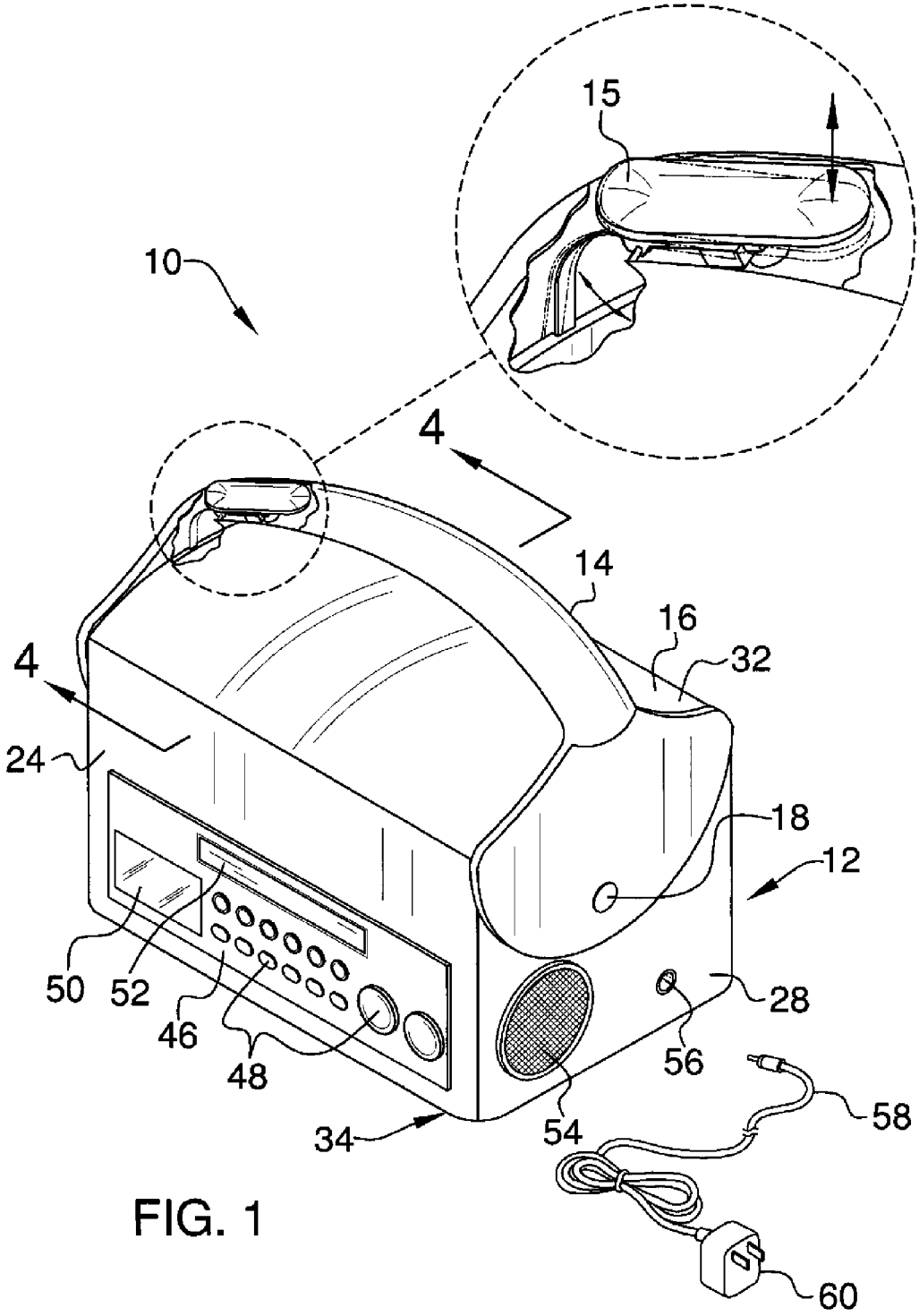
FIG. 1 shows a perspective view of a first embodiment of an audio caddy according to the present disclosure, with a front side visible and with a blow-up of an opening button.
Figure 2:
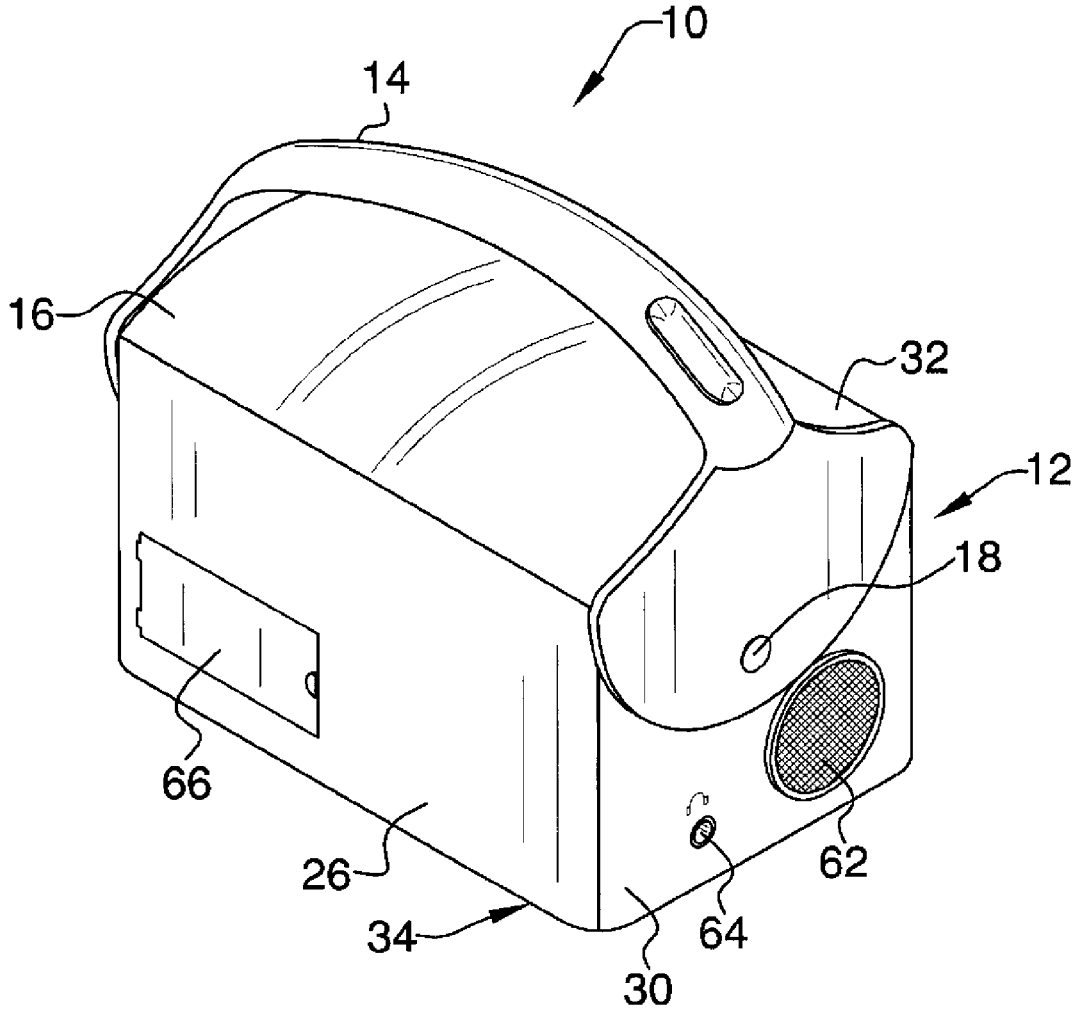
FIG. 2 shows a perspective view of the first embodiment of the audio caddy according to the present disclosure, with a back side visible.

Before starting a detailed description of the disclosure, mention of the following is in order. When appropriate, like reference numerals and characters may be used to designate identical, corresponding, or similar components in different figure drawings.

Referring now to FIGS. 1-4, which illustrate, according to the present disclosure, a first embodiment of an audio caddy, essentially constituting a container for recreational or food items with a portable CD player/radio built in it, the caddy 10 comprises a housing 12 with a handle 14 and a lid 16. The handle 14 is provided with a side button 15, which when depressed unlocks the lid 16. The housing, handle and lid are made of durable plastic. The handle 14 and lid 16 are in a fixed joint with each other or are made integral, and they are connected to the housing 12 at swivel points 18 and 20 forming a swivel axis (not shown), around which the lid 16 is adapted to swing open to reveal an item compartment 22.

Figure 3:
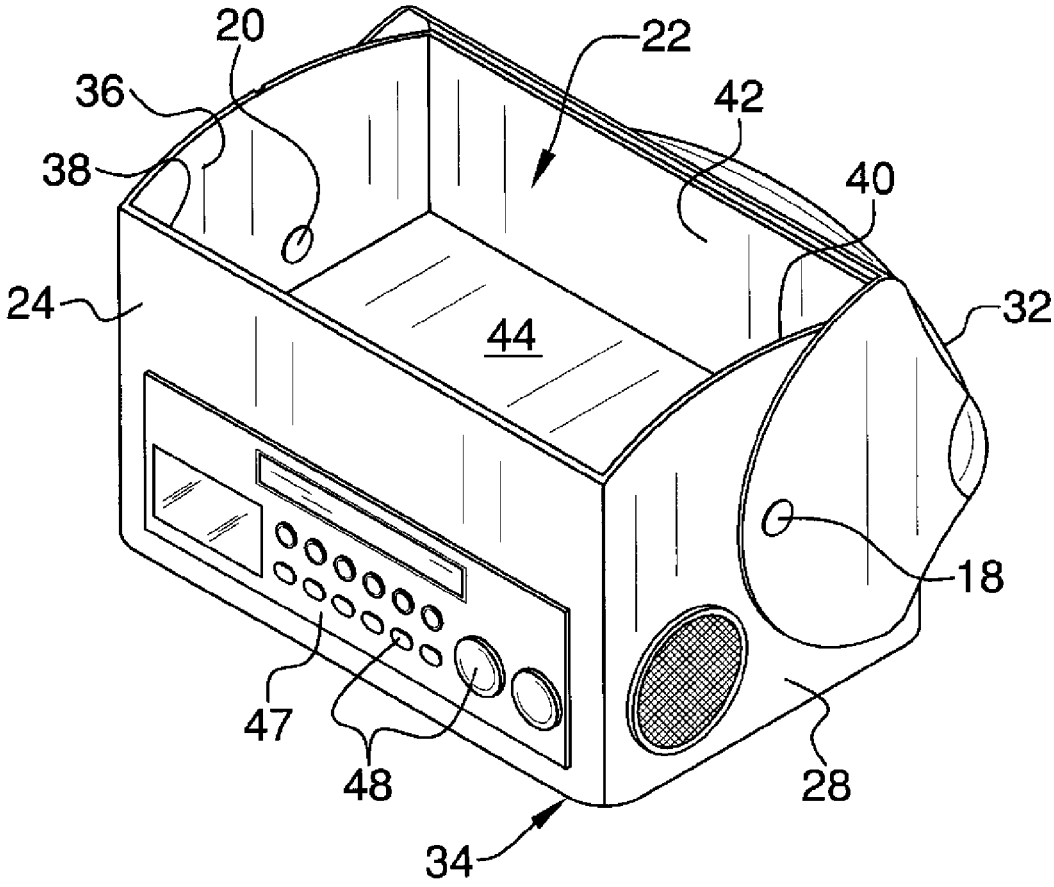
FIG. 3 is a perspective view of the first embodiment of the audio caddy according to the present disclosure, with a front side visible and with a lid opened.
Figure 4:
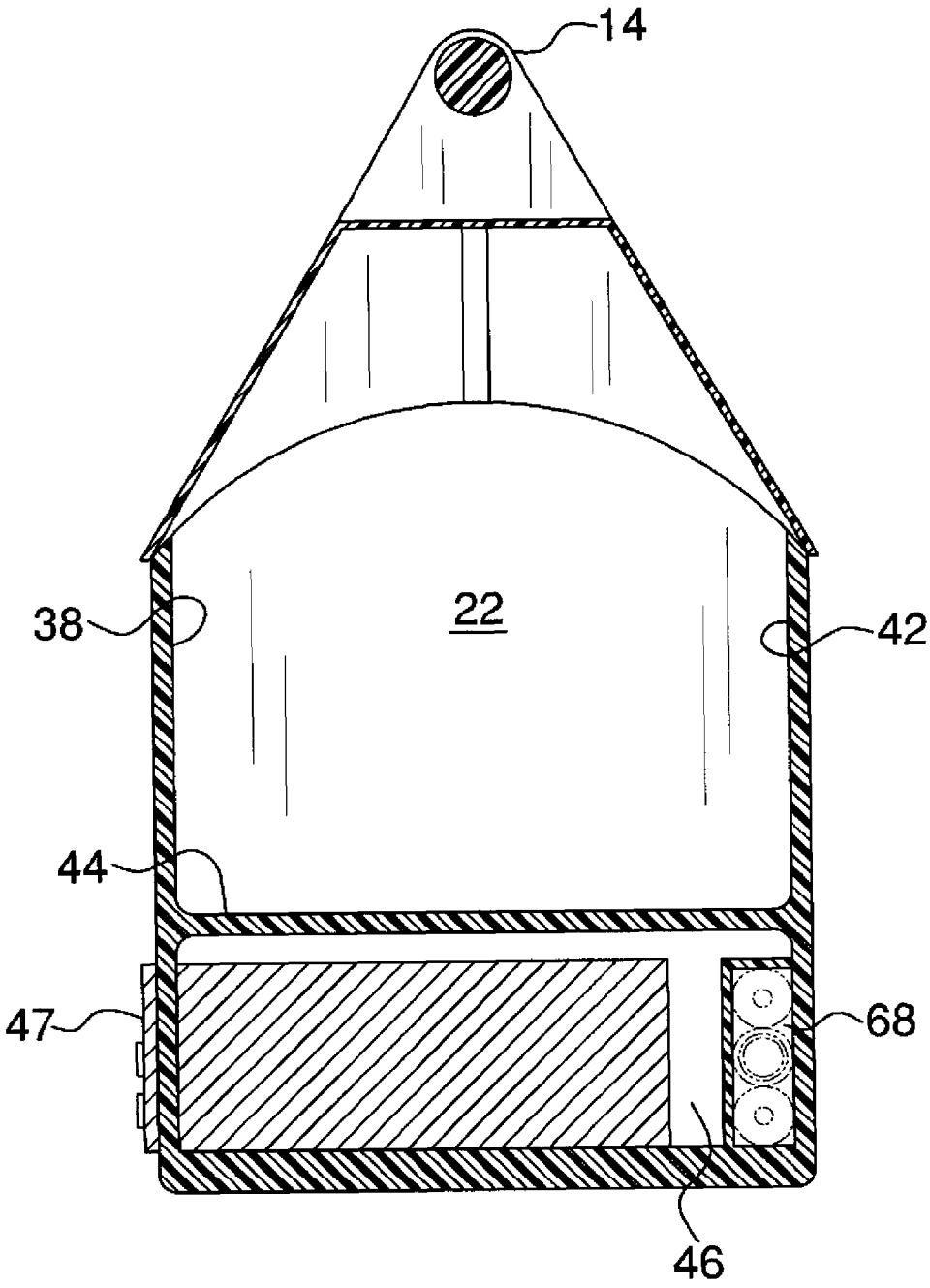
FIG. 4 illustrates a cross-section of the first embodiment of the audio caddy according to the present disclosure, taken along lines 4-4 of FIG. 1.

The housing 12 is defined by a front side 24, a rear side 26, sidewalls 28 and 30, a top 32 including the lid 16 and a bottom 34. On the other hand, the item compartment 22 is defined by walls 36, 38, 40, and 42, as well as by a bottom 44 and by the top 32. It is between the housing bottom 34 and compartment bottom 44 where a portable CD player/radio compartment 46 is located and where a portable CD player/radio unit 47 is inserted. Shown in FIGS. 1 and 3 are controls 48, display 50, and a CD drawer front 52 of the unit 47.

Built in the sidewall 28 are a first speaker 54 and a jack 56 for a cord 58 of an AC adapter 60. Built in the sidewall 30 are a second speaker 62 and a phone jack 64. A cover 66 opens access to a rechargeable battery compartment 68.

Figure 5:
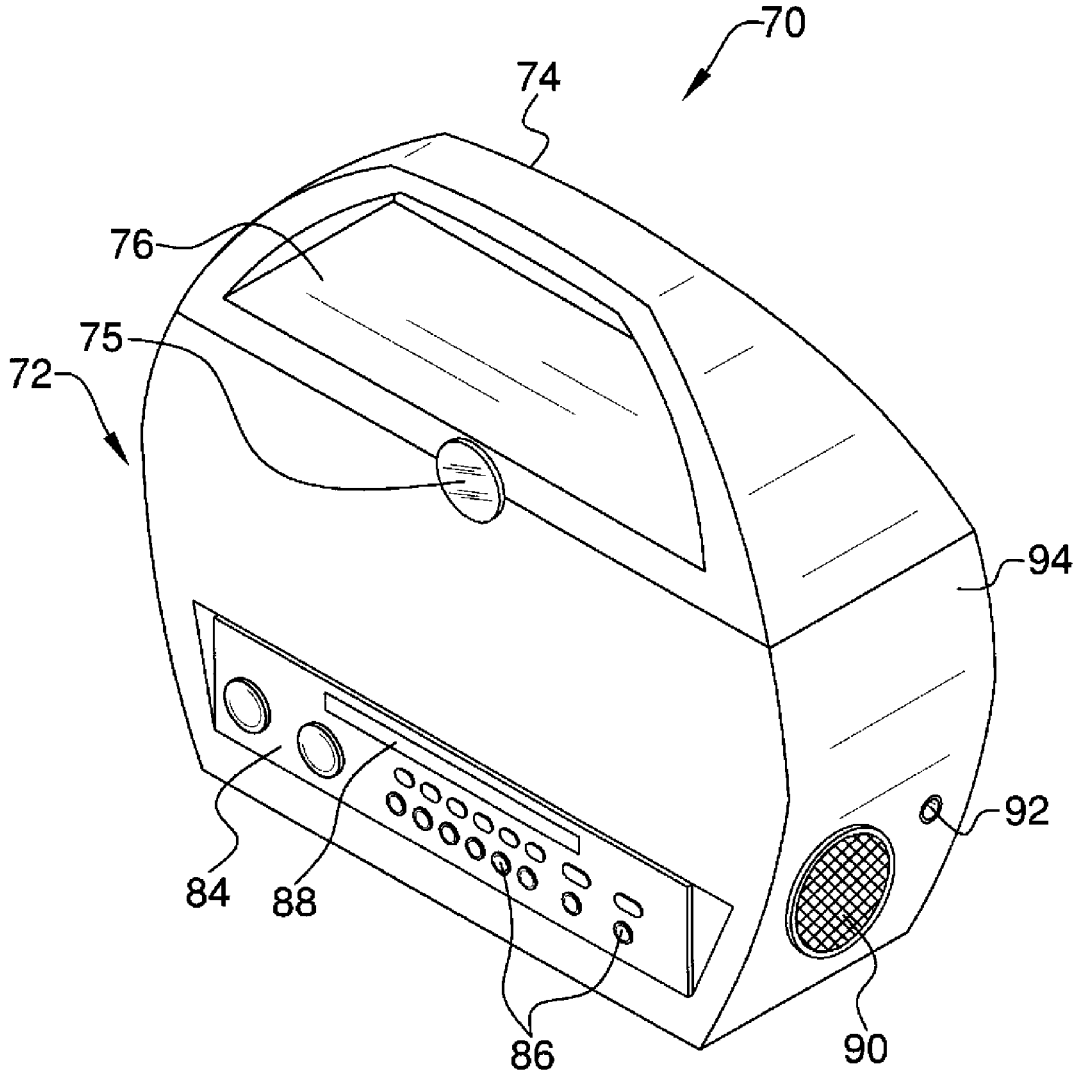
FIG. 5 is a perspective view of a second embodiment of the audio caddy according to the present disclosure, with a front side visible.
Figure 6:
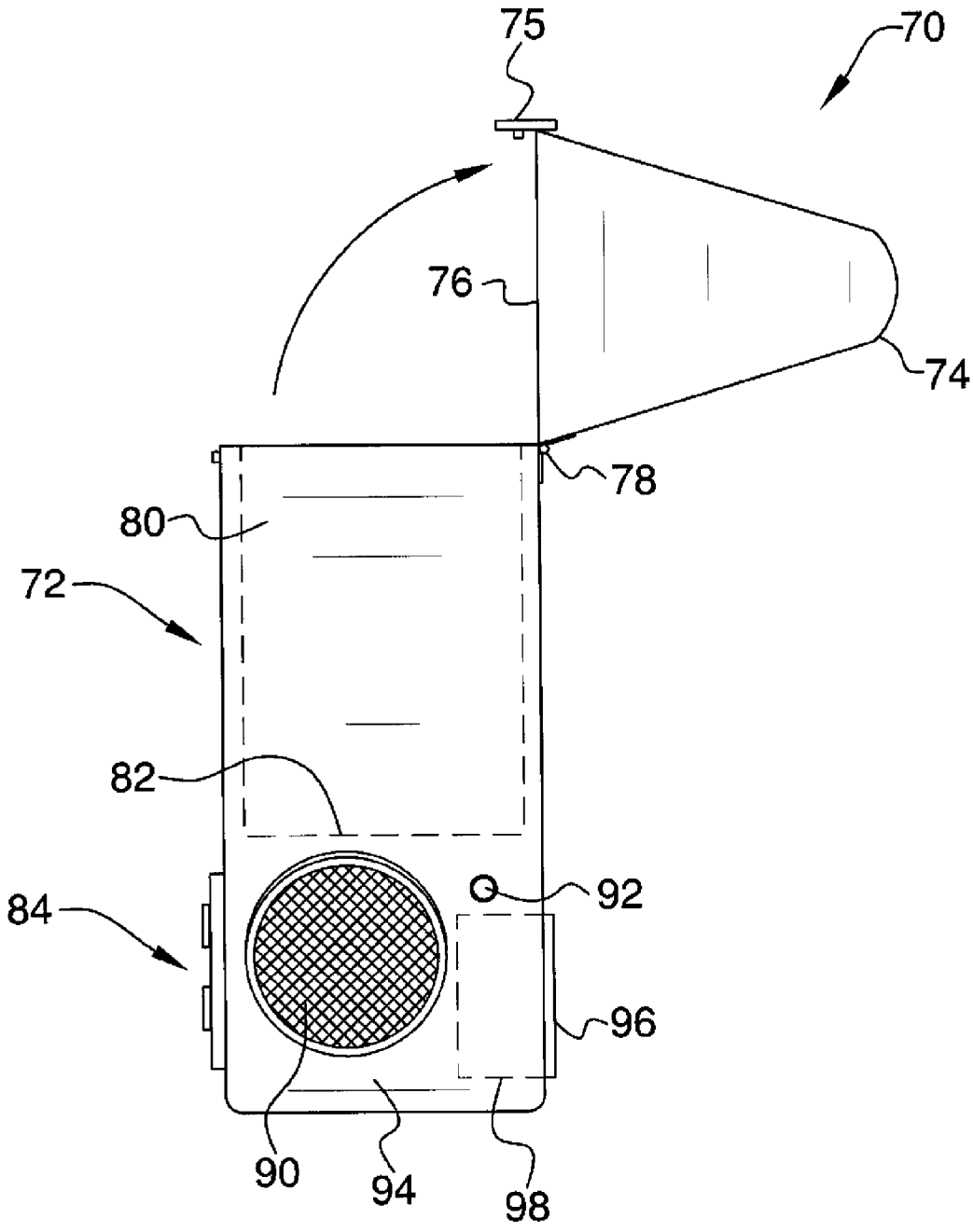
FIG. 6 is a side view of the second embodiment of the audio caddy according to the present disclosure, with a lid opened.

This first embodiment shown in FIGS. 1-4 represents the version of the audio caddy that can be referred to as a lunchbox. A second embodiment shown in FIGS. 5 and 6 illustrates the version of the audio caddy that can be referred to as a classic radio. The audio caddy 70 comprises a housing 72 with a handle 74 and a lid 76 preferably made of durable plastic. The handle 74 is provided with a clasp 75, which is built onto a front side of the housing and which, when undone frees up the lid 76. The housing, handle and lid are made of durable plastic. The handle 74 and lid 76 are in a fixed joint with each other or are made integral, and they are connected to the housing 72 by means of hinge means 78, around which the lid 76 is adapted to turn to reveal an item compartment 80.

A lower portion of the housing 72, under a bottom of the item compartment 80 contains a portable CD player/radio unit 84. Shown in FIGS. 5 and 6 are controls 86 and a CD drawer front 88 of the unit 84. A first speaker 90 and a jack 92 for a cord of an AC adapter (not shown) are built in a sidewall 94. Built in a opposite sidewall (not shown) are a second speaker (not shown) and a phone jack (not shown). A cover 96 opens access to a rechargeable battery compartment 98.

The classic version of the audio caddy according to the present disclosure would be the same as the lunchbox version shown in FIGS. 1-4 except the front and back of the housing would be tapered top and bottom to create a more elegant form. Each side would have a convex curvature.

The audio caddy according to the present disclosure is being suggested since it is believed that it would fulfill the need for a portable CD player/AM-FM radio incorporating a lid with a molded-on handle that would swing open to reveal a large compartment inside. The appealing feature of the audio caddy would be its portability, convenience and ease of use. The audio caddy would make it convenient to carry various items along with a combination CD player/radio-all in one compact unit. The storage area of the audio caddy could hold the user's lunch, CDs, toiletries, cosmetics, school supplies, arts and crafts materials, sewing materials, or other types of items. With the lunchbox version of the audio caddy (the first embodiment), pressing the OPEN button 15 would unlock the lid and allow it to be swung up by the handle to reveal the storage compartment inside. With the classic version the second embodiment), the top would be freed up by undoing the clasp built onto the front of the caddy. Away from a wall outlet, the user would listen to the audio caddy utilizing the rechargeable batteries in the battery compartment. When an outlet was available, the user could connect an AC adapter between the audio caddy and the outlet, powering the unit from the outlet and recharging the batteries at the same time.

Those skilled in the art can now appreciate from the foregoing description that the broad teachings of the present disclosure can be implemented in a variety of forms. Therefore, while this audio caddy has been described in connection with particular examples thereof, the true scope of the disclosure should not be so limited since other modifications will become apparent to the skilled practitioner upon a study of the drawings, specification and claims that follow.

What is claimed is:

1. A portable CD player/radio comprising a housing, the housing accommodating a main compartment having a bottom member for holding recreational or food items and a battery compartment for rechargeable batteries for the CD player/radio, said main compartment comprising a handle unitary with a lid that pivots against a center point of a sidewall at each end of said handle to reveal an interior of said main compartment, a portable CD player/radio being built in the housing under said main compartment bottom member, the face of the CD player/radio with controls, display, and a front of a CD drawer being built onto a bottom of a front face of the housing.

2. The portable CD player/radio as claimed in claim 1, wherein the housing, handle and lid are made of durable plastic.

3. The portable CD player/radio as claimed in claim 1, wherein an AC adaptor jack and a first speaker for the CD player/radio are built into one side of the housing.

4. The portable CD player/radio as claimed in claim 1, wherein a headset jack and a second speaker for the CD player/radio are built into another side of the housing.

5. The portable CD player/radio as claimed in claim 1, further comprising a side button on the top of the handle to open the lid.

6. The portable CD player/radio as claimed in claim 1, further comprising a clasp built onto a front side of the housing, whereby the lid can be freed up by undoing the clasp.

* * * * *